US005372192A

United States Patent [19]

Bitting

[11] Patent Number: 5,372,192

[45] Date of Patent: Dec. 13, 1994

[54] DRAG BLOCK FOR INCREASING THE FLUID RESISTANCE OF WELL PRODUCTION TUBING INADVERTENTLY DROPPED IN A CASED HOLE OF AN OIL OR GAS WELL

[76] Inventor: George C. Bitting, 139 N. Central, Clayton, Mo. 63105-3855

[21] Appl. No.: 60,012

[22] Filed: May 7, 1993

[51] Int. Cl.[5] ..... E21B 17/10

[52] U.S. Cl. ..... 166/241.6; 166/241.4

[58] Field of Search ..... 166/241.4, 241.6, 241.7

[56] References Cited

U.S. PATENT DOCUMENTS

| | | | |
|---|---|---|---|
| 1,527,713 | 2/1925 | Stout | 166/241.4 |
| 1,560,468 | 11/1925 | Dodson | 166/241.4 |
| 1,573,031 | 2/1926 | Bettis et al. . | |
| 1,724,176 | 8/1929 | Biedermann | 166/241.4 |
| 1,730,158 | 10/1929 | Merrick | 166/241.4 |
| 1,750,851 | 3/1930 | Meier | 166/241.4 |
| 2,163,932 | 6/1939 | Bettis . | |
| 2,166,116 | 7/1939 | Bettis . | |
| 2,338,937 | 1/1944 | Hait . | |
| 2,368,415 | 1/1945 | Grant . | |
| 2,436,994 | 3/1948 | Gillespie | 166/241.4 |
| 2,739,018 | 3/1956 | Collett . | |
| 3,289,768 | 12/1966 | Solum . | |
| 3,330,358 | 7/1967 | Ward | 166/241.4 X |
| 3,399,730 | 9/1968 | Pourchot . | |
| 3,560,060 | 2/1971 | Morris | 166/241.4 |
| 4,483,395 | 11/1984 | Kramer et al. . | |
| 4,658,896 | 4/1987 | Milam . | |
| 4,858,688 | 8/1989 | Edwards et al. | 166/241.4 |
| 4,907,661 | 3/1990 | Lloyd . | |
| 5,095,981 | 3/1992 | Mikolajczyk . | |
| 5,191,938 | 3/1993 | Sable et al. | 166/241.4 X |

*Primary Examiner*—Ramon S. Britts
*Assistant Examiner*—Frank S. Tsay
*Attorney, Agent, or Firm*—Rogers, Howell & Haferkamp

[57] ABSTRACT

The present invention pertains to a drag block that is attached over the exterior of, or screwed onto as an integral part of, oil well production tubing to increase the fluid resistance of the tubing. The increased fluid resistance of the tubing slows its descent through an oil or gas well filled or partially filled with fluid, thereby reducing the risk of damage to the casing, tubing or the well itself when a string of production tubing is inadvertently dropped through the well and hits bottom.

25 Claims, 3 Drawing Sheets

DRAG BLOCK FOR INCREASING THE FLUID RESISTANCE OF WELL PRODUCTION TUBING INADVERTENTLY DROPPED IN A CASED HOLE OF AN OIL OR GAS WELL

BACKGROUND OF THE INVENTION (1) Field of the Invention

The present invention pertains to a drag block that is attached over the exterior of, or screwed onto as an integral part of, oil or gas well production tubing which is hung or being run in a cased hole to increase the fluid resistance of the tubing if it is dropped in the hole and descends through fluid contained in the casing. In particular, the drag block is attached to the production tubing to avoid damage to the casing pipe and the tubing when a length of the production tubing having the drag block attached is inadvertently dropped into and through the casing. In addition, the invention will lessen the cost of "fishing" the dropped tubing out of the hole by reducing the chances of its becoming stuck when it hits bottom. By preventing damage to the casing and production tubing the drag block will minimize the cost of retrieving the dropped tubing and will prevent the possible loss of the well.

(2) Description of the Related Art

It is well known in the prior art that gas or oil wells being prepared for production are provided with a casing pipe to prevent the walls of the well from caving in, to seal off any levels of strata containing water that communicate with the drilled well or fresh water zones and to confine any gas or oil to the strata level where they were encountered. Well casings are typically large diameter pipes and are available in a variety of standard sizes, weights, wall thicknesses, and lengths. Individual lengths or joints of casing pipe are connected together end to end as they are inserted downward into the drilled wells by couplings, also known in the art.

Several lengths or joints of casing connected end to end are typically employed in casing an oil or gas well. A joint is typically about 40 feet in length. The total length of joints of casing inserted downward into a drilled hole can reach thousands of feet, and casing will be run to the bottom of the hole and cemented in place. Production tubing is then inserted downward through the casing pipe in the same way that casing is run into the open hole. A pump may then be run down the tubing on rods, which are connected joint by joint at the surface. The uppermost rod, or "polished rod" is then tied on to the "horses head" of the surface pumping unit. Operation of the pumping unit activates the pump and conveys the fluid of the well upward through the production tubing and into the tanks or storage facilities on the surface.

The casing pipe in a gas or oil well is often the most expensive portion of the well's construction, representing as much as one-third of the cost of the oil or gas well. Damage to the casing pipe of a producing well can represent a substantial expense, not only for the repair of the casing pipe but also for the downtime of the productive well. Moreover, damaged casing can make it impossible to run production tubing or other equipment into the well resulting in the loss of the well.

Casing pipe of production wells can be damaged in a number of ways and the productivity of the well itself affected. As an example, an oil well work crew is pulling the production tubing of an oil well that is ten thousand feet deep to service the well and inspect the tubing.

Tubing is usually pulled out of the well in "stands" of two or three joints. A stand is unscrewed and stood in the derrick of the rig. The tubing in the hole is suspended at the surface by the application "slips". The fluid level of the well is, for example, at seven thousand feet below the surface. The crew has all but two thousand feet of the production tubing pulled out of the hole when they fail to properly close the slips around the tool joint at the surface, and the two thousand foot length of tubing weighing about five tons, is dropped down the well. The cylindrical exterior configuration of the production tubing and its weight will cause it to hit the bottom of the well with considerable force. The fluid filling the bottom three thousand feet of the well will not have any significant effect on slowing the descent of the production tubing dropped down the well. The impact of the two thousand feet of production tubing at the bottom of the hole will result in the production tubing being corkscrewed, bent and twisted, possibly causing the casing to rupture. The twisted tubing may become jammed and stuck in the hole. The result is a very expensive fishing job, the replacement of both casing and tubing, and possibly the loss of a productive well.

For another example, take the same well during its normal production phase. The string of production tubing is 7,500 feet in length, hung at the well head and secured at the bottom with a tubing anchor, which locks onto the casing. The pump is at 7,500 feet also, at the end of the string of rods which is clamped onto the horses head of the surface pump. The tubing parts one joint from the surface, the tubing anchor fails to hold and 7,470 feet of tubing and rods, weighing about 28 tons, fall to the bottom at 10,000 feet, corkscrewing, bending and jamming inside the casing, causing the loss of the hole.

SUMMARY OF THE INVENTION

The present invention provides a drag block or brake that is attached to the exterior of, or screwed onto as an integral part of, production tubing that increases the fluid resistance of the tubing and significantly slows the descent of the tubing through the fluid contained in the casing when the tubing is inadvertently dropped, or breaks loose. The drag block is provided in several embodiments with each embodiment being constructed of metal, high impact rubber, or other equivalent types of materials.

The preferred configuration of the first embodiment of the drag block has a one piece construction with a longitudinal length of about 18 inches, although the dimensions of both embodiments of the drag block will vary to best suit them for their particular intended application. The dimensions referred to in the description of the two embodiments of the invention are for illustrative purposes only and should not be interpreted as limiting. The exterior surface of the drag block is divided into three sections along its longitudinal length. A middle section of the block has a cylindrical configuration that extends for about one-third of the total length of the block. The outside diameter of the middle section is dimensioned just slightly smaller than the inside diameter of the casing into which the drag block fits. The sections of the block's exterior-surface on opposite sides of the middle cylindrical section have the configurations of truncated cones that taper as they extend from the intermediate section of the block to the opposite distal ends of the block. A cylindrical center bore extends longitudinally through the block between its longitudinally opposite ends. The inside diameter of the center bore is dimensioned just slightly larger than the outside diameter of the production tubing onto which the block attaches. This enables the drag block to be slip fit over the male end of the production tubing and to slide over the exterior surface of the tubing to the desired position up against the upset at the female end of the joint of tubing. To secure the drag block in this position on the exterior surface of the production tubing, pluralities of set screws are mounted in interior threaded holes extending through the sides of the drag block from its exterior surface to its center bore. Tightening down the plurality of set screws in their respective holes until the screws engage in contact with the exterior surface of the production tubing securely mounts the drag block on the exterior surface of the production tubing in the desired position of the block relative to the tubing.

With the drag block of the invention attached to the exterior surface of production tubing, if a length of production tubing inadvertently drops through the casing, the middle section of the drag block, having an outside diameter only slightly smaller than the inside diameter of the casing, functions as a flow restriction that inhibits the descent of the dropped length of production tubing through the interior of the casing. Since there is only a small radial spacing between the exterior surface of the drag block middle section and the interior surface of the casing, when the dropped length of production tubing with the drag block attached descends through the fluid contained in the casing, for example water and/or oil, the limited spacing between the block exterior surface and the casing interior surface restricts the flow of fluid between these two surfaces creating a drag on the production tubing that slows its descent through the fluid. In this manner, the drag block of the present invention prevents the dropped length of production tubing from impacting with great force at the bottom of the hole reducing significantly the risk of damage to the casing pipe, tubing or to the hole itself.

In the preferred application of the present invention, pluralities of drag blocks are spatially arranged on the production tubing at various depths. The lowermost of the drag blocks has an outside diameter that is the smallest of the plurality of drag blocks. A second, larger diameter drag block would be secured spaced above the lowermost drag block by about three lengths of production tubing (approximately 90 feet). A third drag block, having the largest diameter, would be positioned about three production tubing lengths above the second drag block. The diameter of the third drag block would be only slightly smaller than the inside diameter of the casing and would provide the most resistance to fluid flow between the drag block and casing. Two or three additional drag blocks having the largest diameter would be positioned at intervals of one or more tubing lengths above the third drag block. Besides slowing the descent of dropped production tubing through fluid contained in the casing, the plurality of drag blocks secured to the production tubing also serve to prevent the tubing from striking against the interior surface of the casing as the tubing is raised and lowered through the pipe. In addition, the drag blocks or brakes serve to prevent the buckling of dropped tubing on impact at bottom.

A second embodiment of the drag block of the invention is substantially identical to the first embodiment except that it is provided in two parts. The second embodiment is split along the longitudinal length of the block so that the two parts are mirror images of each other. Each part is formed with ribs and grooves that are complementary to ribs and grooves on the other part to enable the two parts to be slip fit together on opposite sides of a joint of tubing. This second embodiment is also provided with pluralities of set screws that are tightened down to securely hold the drag block in its desired position on the exterior of the production tubing.

In a further embodiment of the invention, the drag block has an exterior configuration substantially identical to that of the first described embodiment of the drag block except that it is not held to the exterior surface of production tubing by set screws. In this embodiment of the drag block the inside diameter of its center bore is dimensioned to match the outside diameter of production tubing at the threaded connectors provided at opposite ends of production tubing. Internal threading is provided at the opposite ends of the drag block center bore that is complementary to the external threading at the opposite ends of the production tubing. This embodiment of the drag block is threaded onto ends of production tubing and is used in place of a conventional coupling for attaching adjacent joints of tubing. The exterior configuration of this embodiment of the block functions in substantially the same manner as the previously described embodiments.

In a further embodiment of the drag block that is a variant of the last-described embodiment, the opposite ends of the drag block are provided with external threading. The external threading at the opposite ends of the block is dimensioned complementary to the internal threading of a conventional tubing coupling. This embodiment of the drag block is attached in a length of production tubing by tubing couplings being attached over the external threading at the opposite ends of the drag block and over the external threading at the ends of two strings of production tubing, the drag block and two tubing couplings attaching or connecting together the two strings of production tubing.

In a further embodiment, the drag block is formed as an integral part of a sublength of production tubing or as a part of a conventional length of production tubing. The drag block configuration can be formed integrally to the exterior of the length of production tubing adjacent either of its ends or at any position intermediate its ends.

In a still further embodiment of the drag block of the invention, the configuration of the first described embodiment of the drag block is modified with the bottom tapered section of the block's exterior surface being removed and replaced by an indented end surface at the bottom end of the block. The indented surface extends upwardly from the periphery of the drag block exterior surface to the periphery of the drag block center bore. This indented end surface forms a cup shape cavity in the bottom end of the drag block that enhances its ability to resist the flow of fluid around the drag block when a length of production tubing having the block attached is dropped through a well.

BRIEF DESCRIPTION OF THE DRAWINGS

Further objectives and features of the present invention are revealed in the following detailed descriptions of the preferred embodiments of the invention and in the drawing figures wherein.

DESCRIPTION OF THE PREFERRED EMBODIMENTS

Figure 1:
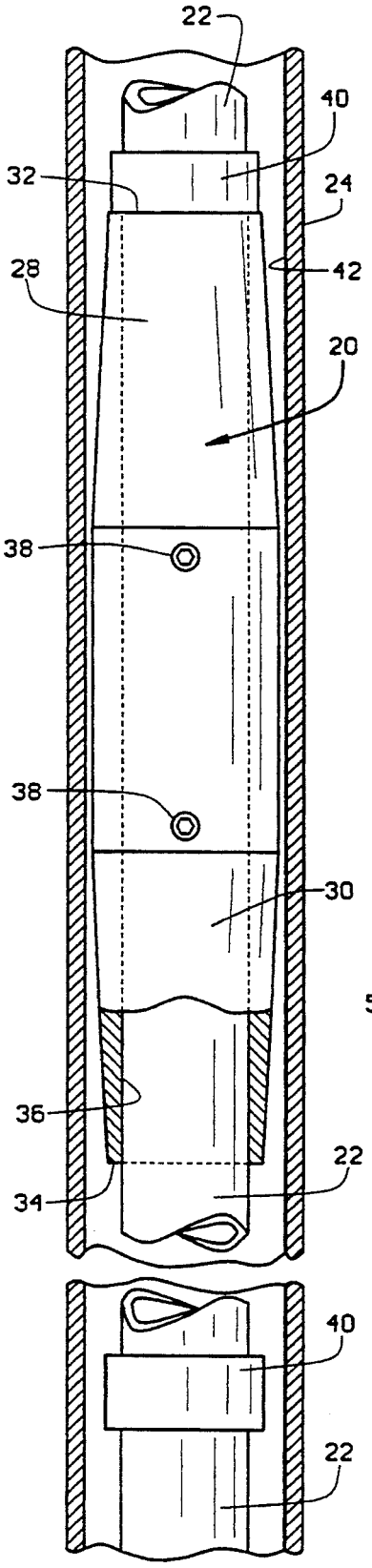
FIG. 1 is a partial elevation view, in section, of an operative environment of the drag block of the invention.
Figure 2:
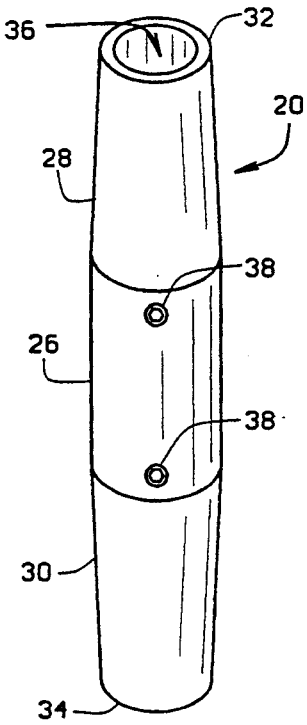
FIG. 2 is a perspective view of a first embodiment of the drag block.
Figure 3:
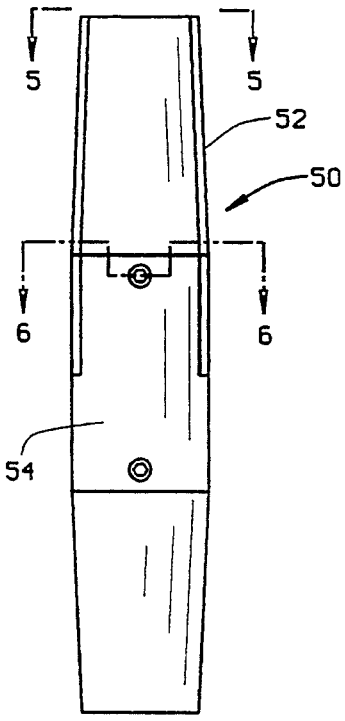
FIG. 3 is an elevation view of the second embodiment of the drag block.
Figure 4:
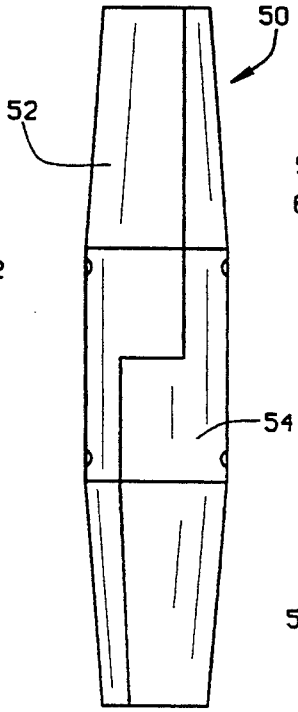
FIG. 4 is a side elevation view of the second embodiment.
Figure 5:
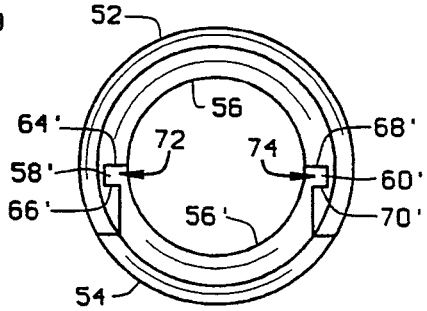
FIG. 5 is a top plan view along the line 5—5 of FIG. 3.
Figure 6:
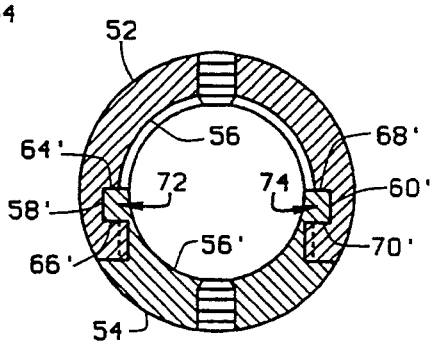
FIG. 6 is a plan view, in section, along the line 6—6 of FIG. 3.
Figure 8:
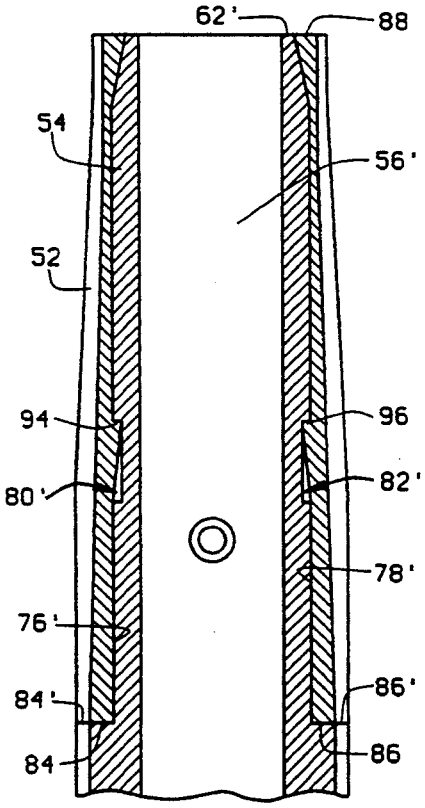
FIG. 8 is a partial view, in section, taken along the line 8—8 of FIG. 7.
Figure 7:
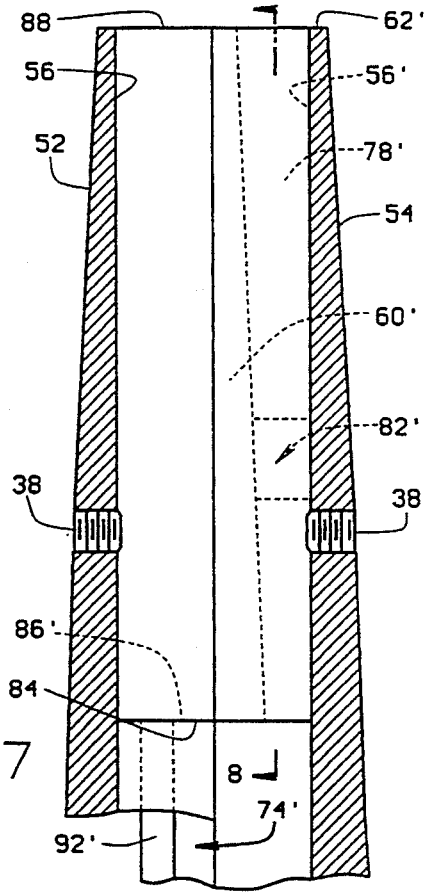
FIG. 7 is a partial view, in section, showing the detail of the second embodiment of the drag block.
Figure 9:
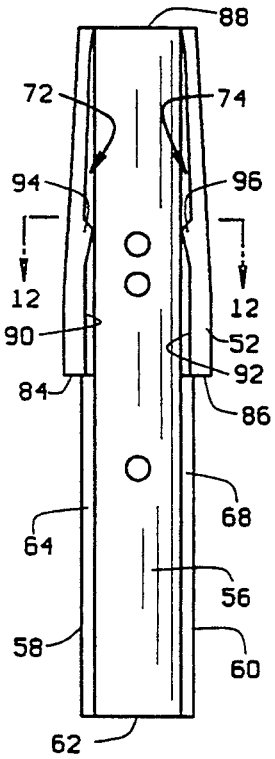
FIG. 9 is an elevation view of one part of the second embodiment of the drag block.

FIG. 1 shows the first embodiment of the drag block 20 of the present invention in its operative environment. The drag block 20 is shown secured on the exterior surface of a length of production tubing 22 contained inside the casing of an oil or gas well 24. FIG. 2 shows a perspective view of the drag block 20 removed from the production tubing and casing interior. This embodiment of the block is constructed of a single piece of material having an exterior surface with a middle section 26 and opposite end sections 28, 30. The middle section of the block exterior surface 26 is formed with a cylindrical configuration having an outside diameter slightly smaller than the inside diameter of the casing pipe 24. The longitudinal length of the middle section 26 is about one-third of the total length of the drag block. The opposite end section surfaces 28, 30 are substantially identical and have the configurations of truncated cones. The end sections taper from the opposite ends of the middle section 26 to the distal ends 32, 34 of the drag block. A center bore 36 extends longitudinally completely through the interior of the drag block between its opposite distal ends 32, 34. The center bore 36 has an inside diameter dimensioned slightly larger than the outside diameter of the male end of the production tubing 22 over which the drag block must fit. A pair of threaded holes (not shown) extend from the intermediate surface 26 of the drag block through to the center bore 36 and a set screw 38 is screw threaded into each of the holes.

In one application of the drag block, its overall longitudinal length between its opposite distal ends 32, 34 is 18 inches. The middle section 26 and opposite end sections 28, 30 are formed with generally equal lengths of about 6 inches. Although circumferential lines are shown in the drawings separating the middle section 26 from the opposite end sections 28, 30, the entire outside surface of the drag block is smooth with the middle section surface 26 merging smoothly with the tapered surfaces of the end sections 28, 30. The outside diameter of the distal ends 32, 34 of the drag block is 3 inches and increases to its maximum diameter of $3\frac{1}{2}$ inches as the exterior surface of the end sections 28, 30 extend toward the exterior surface of the middle section 26. Substantially the entire longitudinal length of the middle section 26 of the exterior surface has an exterior diameter of $3\frac{1}{2}$ inches. The center bore 36 of the drag block has an inner diameter of $2\frac{3}{8}$ inches. The inner diameter is constant through the entire longitudinal length of the center bore.

Again, it is reemphasized that the dimensions given above are illustrative only to provide a good mental picture of the proportions of the drag block and are not to be interpreted as limiting. In variant embodiments of the drag block employed on production tubing and in casing pipe having various different dimensions, the dimensions of the drag block will correspondingly change. Moreover, the proportionate lengths of the middle and end sections of the drag block may change and in some applications the lengths and/or tapers of the end sections may be different. In such instances the two parts of the second embodiment of the drag block may not be true mirror images of each other.

FIG. 1 shows one example of the use of the drag block 20 of the present invention on oil well production tubing 22 contained in a casing pipe 24. In the example shown the drag block 20 is attached over a joint of production tubing 22 that is one in a series of joints of tubing connected end to end and inserted down the inside of the casing. The adjacent ends of the joint of production tubing 22 are connected by conventional tubing couplings 40. Prior to one joint of production tubing 22 being connected to the next joint of tubing, the drag block 20 of FIG. 2 is slip fit over the lower free end of the production tubing and is passed upward over the exterior surface of the tubing to its desired position up against the upset of the top end of the tubing, or in the absence of an upset, up against the tubing coupling. When in the desired position on the exterior surface of the tubing, the set screws 38 are tightened down to hold the drag block in its desired position. The set screws 38 are an added means of securing the drag block in its desired position on the tubing. In the example shown in FIG. 1, the drag block 20 is positioned over the exterior surface of the tubing 22 adjacent its top free end. Attaching the next length of production tubing 22 with a tubing coupling 40 results in the drag block 20 abutting up against the underside of the tubing coupling 40 whereby the abutment of the drag block with the tubing coupling will also serve to secure the drag block in its desired position on the exterior surface of the production tubing 22.

Joints of tubing are run into the interior of the casing 24 with the drag block secured. As shown in FIG. 1, with the drag block inserted inside the casing the exterior surface of the block acts as a flow restriction inhibiting the flow of fluid between the interior surface 42 of the casing and the exterior surface sections 26, 28, 30 of the drag block. The increase in the exterior diameter of the drag block toward the middle surface section 26 produces the flow restriction that inhibits the flow of fluid between the block exterior surface and the casing pipe interior surface. It can be seen that should production tubing 22 be dropped through the interior of the casing 24, as the tubing falls through fluid contained in the casing the restriction formed between the exterior surface of the drag block and the interior surface of the casing pipe will cause the rate of descent of the tubing through the fluid to decrease, thereby reducing the risk of damage to the casing, tubing or to the well itself on impact of the dropped tubing at the bottom of the well. The drag block 20 secured to the exterior of the production tubing 22 will also prevent the tubing from banging against the interior surface of the casing as it falls, and by their occupying the space between the exterior of the production tubing and the interior of the casing, the drag blocks will also reduce the risk of damage to the production tubing on impact at the bottom of the well.

FIG. 1 illustrates only one drag block 20 secured to a length of production tubing 22. In one operative environment, a plurality of similar blocks are secured over many joints of production tubing as they are run into the hole. As an example, one operative environment of use of the drag block 20 would involve a conventional set-up of production tubing run into a cased hole. The installation procedure would involve the use of a bull plug to seal off the bottom end of the tubing and, in the case of a well being set up for pumping, a perforated sub would be connected below the seat where the pump is to be set. The first of the plurality of drag blocks to be connected to the tubing would be connected at the top end of the third joint of tubing (about 90 feet off the bottom). The drag block would be connected so that it would about against the underside of the tubing coupling connecting the top free end (female end) of the third joint of tubing to the next joint of tubing to be added to the production string. In casing having an inside diameter of $4\frac{3}{4}$ inches, this first drag block would have the smallest outside diameter of the plurality of drag blocks to be connected to the joints of production tubing, for example $3\frac{1}{2}$ inches. A second, larger diameter drag block would be connected to a joint of tubing, for example three coupling joints above the first drag block (or approximately 90 feet for 30 foot joints of production tubing). This second drag block would have a slightly larger diameter, for example 4 inches. A third drag block having the largest diameter, for example $4\frac{1}{2}$ inches, would be connected to a joint of production tubing three joints above the second drag block (approximately 90 feet). Two or three additional of the largest diameter drag blocks could be connected at one joint intervals (approximately 30 feet) above the third drag block. Additional blocks could be connected at three to six joint intervals (approximately 90 to 180 feet) above that. The purpose for these additional drag blocks would be threefold: to further slow down the rate of descent of dropped tubing, to minimize the contacting or banging of the tubing against the interior surface of the casing, and to help prevent buckling of joints of tubing inadvertently dropped through the casing upon impact at bottom.

FIGS. 3 through 13 show a second embodiment of the drag block 50 of the invention. The second embodiment of the drag block has an exterior configuration substantially identical to that of the first embodiment and is employed in the identical manner as the first embodiment. Additionally, the second embodiment of the drag block may be constructed with the same materials as the first embodiment. The only difference between the first and second embodiments of the drag block is that the second drag block 50 is constructed of two separate parts 52, 54 that are substantially identical to each other and are attached to each other over the exterior surface of the production tubing to secure the drag block to the tubing. Because the two parts 52, 54 of the block are substantially identical to each other, only one of the two half parts will be described in detail. The components of the second drag block 54 corresponding to the described components of the first drag block 52 are given the same reference numerals as those of the first drag block followed by a prime (').

Figure 10:
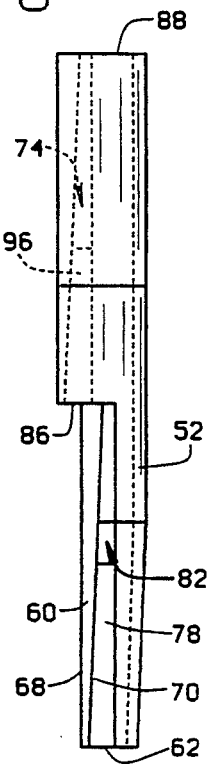
FIG. 10 is a view similar to that of FIG. 9 with the part of the drag block rotated 90°.
Figure 11:
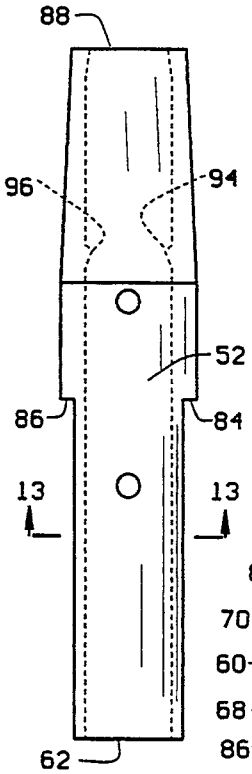
FIG. 11 is a similar view to that of FIG. 9 with the part of the drag block rotated 180°.
Figure 12:
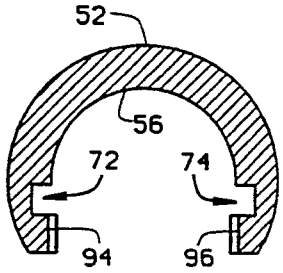
FIG. 12 is an elevation view, in section, taken along the line 12—12 of FIG. 9.
Figure 13:
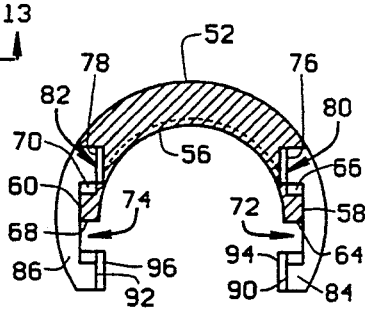
FIG. 13 is a view, in section, taken along the line 13—13 of FIG. 11.

The drag block half part 52 has a generally semi-cylindrical configuration including a semi-cylindrical center bore 56. Together, the center bores of the two parts are dimensioned to fit around the exterior surface of a joint of production tubing in the same manner as the center bore 36 of the first described embodiment, or they may be assembled to the tubing as will be explained. Radially projecting and longitudinally extending ribs 58, 60 are provided at the sides of the first part 52 adjacent the bore opening and extending over substantially one-half of the length of the part. The configurations of the ribs 58, 60 taper slightly as they extend from the middle of the part 52 to the bottom distal end 62 of the part as best seen in FIG. 10. The tapering configuration of opposite surfaces 64, 66, 68, 70 of the respective ribs 58, 60 are designed to enable the opposed rib surfaces 64, 68 of the two drag block parts 52, 54 to slide against each other in the assembly of the parts together, and to enable the easy insertion of the two ribs 58, 60 into complementary shaped grooves 72, 74.

Between each of the ribs 58 and 60 and the exterior surface of the drag block are flat surfaces 76, 78 extending substantially the same longitudinal length as the ribs. Each of the flat surfaces has a recess 80, 82 formed therein. The recesses 80, 82 are provided to receive locking teeth on the complementary parts of the two parts of the drag block as will be explained.

The ribs 58, 60 terminate at shoulders 54, 56 formed in the intermediate section of the drag block. As is best seen in FIG. 10, the portion of the drag block exterior surface above the shoulders 84, 86 as viewed in the drawing figure has a greater portion of the semi-cylindrical exterior surface of the assembled drag block parts than does the portion of the exterior surface of the part below the shoulders. However, when the two parts are assembled together the cylindrical configuration of the intermediate section and the truncated cone configuration of the two end sections extend continuously around the drag block.

The pair of grooves 72, 74 extend longitudinally through the interior surface of the block part 52 adjacent the semi-cylindrical interior bore 56 of the part. The grooves 72, 74 begin at the shoulders 84, 86, respectively, adjacent the ribs 64, 68 and extend through to the upper distal end 88 of the part as viewed in FIGS. 9–11. Adjacent the grooves 72, 74 are flat, longitudinally extending surfaces 90, 92. The surfaces 90, 92 also extend from the shoulders 84, 86 to the distal ends 88 of the part. The surfaces 90, 92 are configured complementary to the surfaces 76, 78 adjacent the two ribs 58, 60. A single tooth 94, 96 is formed on each of the flat surfaces 90, 92 for engagement in the recesses 80', 82' provided in the second part of the drag block when the two parts are assembled together. The engagement of the teeth 94, 96 in their respective recesses 80', 82' securely holds the two parts of the drag block second embodiment 50 assembled together over the exterior surface of the well production tubing.

In assembling the two half parts 52, 54 of the second embodiment of the drag block 50 over the exterior surface of a length of production tubing, the two parts are positioned on opposite sides of the exterior surface of the tubing spaced longitudinally from each other with the lower ends 62 of the two parts positioned adjacent the shoulders 84, 86 of the two parts. The two parts are then moved longitudinally toward each other over the exterior surface of the production tubing with the ribs 58, 60 of the two parts being inserted into the respective grooves 74, 72 of the complementary parts. The two parts are continued to be moved toward each other until the projecting teeth 94, 96 of each part engage in the respective recesses 82, 80 of the complementary part, thereby snap fitting the two parts of the second embodiment of the drag block 50 into their assembled condition over the exterior surface of the production tubing. The teeth 94, 96 engaging in the recesses 82, 80 will prevent the two parts 52, 54 of the drag block from moving longitudinally relative to each other to become disassembled from the exterior of the production tubing. The center bore 56 of the second embodiment of the drag block 50 may be configured to engage in friction engagement with the exterior surface of the production tubing to prevent the drag block from moving over the exterior surface, or as in the first embodiment of the invention a plurality of set screws 98 may be provided in complementary threaded holes to engage the exterior surface of the production tubing when tightened down and thereby securely hold the drag block in an adjusted position on the exterior surface of the tubing. The second embodiment of the drag block may be employed on production tubing in the same manner as that described above with reference to the first embodiment of the block.

Figure 14:
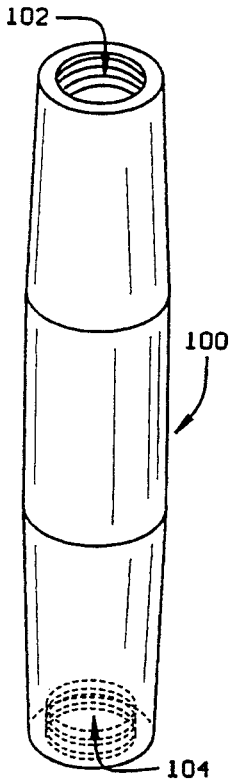
FIG. 14 is a perspective view of a further embodiment of the drag block of the invention.

FIG. 14 shows a further embodiment of the drag block of the invention 100 that is substantially identical to the first described embodiment except that the set screws have been deleted and replaced by internal threading 102, 104 at the opposite ends of the drag block center bore. The internal threading 102, 104 is dimensioned complementary to the external threading provided at the opposite ends of conventional joints of production tubing. This embodiment of the drag block 100 is attached between adjacent joints of production tubing in place of a conventional tubing coupling. The opposite ends of the drag block 100 are screw threaded over the external threading at the opposed ends of two joints of production tubing, thereby attaching the two joints of tubing together with the drag block 100. The exterior configuration of the drag block 100 is substantially identical to that of the first described embodiment of the drag block and functions in substantially the same manner.

Figure 15:
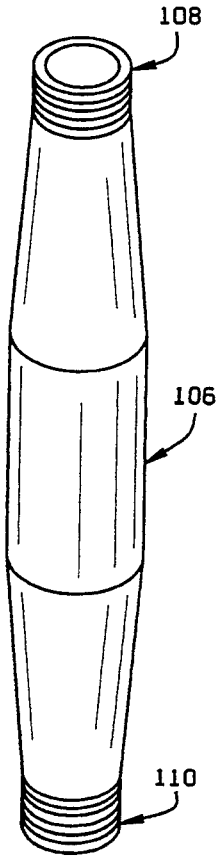
FIG. 15 is a perspective view of a further embodiment of the invention.

A further embodiment of the drag block 106 is shown in FIG. 15. This embodiment is substantially identical to the first described embodiment and the embodiment of FIG. 14 except that the opposite ends of the drag block are provided with external threading 108, 110. The external threading 108, 110 is dimensioned complementary to the internal threading of a conventional production tubing coupling, enabling this embodiment of the drag block 106 to be connected between adjacent joints of production tubing by conventional tubing couplings. The couplings are screw threaded over the external threading 108, 110 of the drag block 106 and the external threading at the adjacent ends of the production tubing. In this manner, the embodiment of the drag block 106 shown in FIG. 15, together with two conventional tubing couplings, are employed to connect together adjacent joints of production tubing. The exterior configuration of the FIG. 15 drag block 106 is substantially identical to that of the first described embodiment and functions in substantially the same manner.

Figure 16:
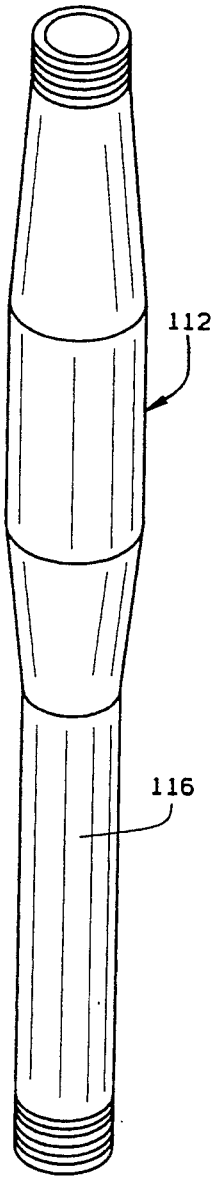
FIG. 16 is a perspective view of a further embodiment of the invention.
Figure 17:
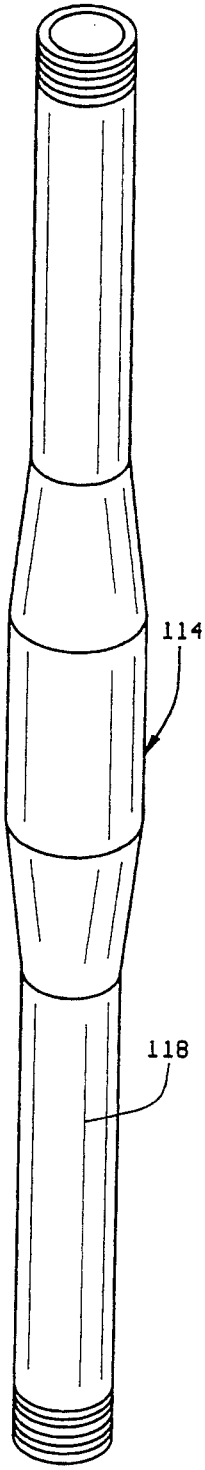
FIG. 17 is a perspective view of a further embodiment of the invention.

FIGS. 16 and 17 show additional embodiments of the drag block of the invention 112, 114 where the drag blocks themselves are formed as integral parts of a joint of subtubing 116 and a joint of production tubing 118, respectively. As is conventional, the subtubing 116 and production tubing 118 have external threading provided at their opposite ends for connection of the tubing to adjacent joints of tubing by conventional couplings. However, the exterior surface of both the subtubing 116 and the production tubing 118 are modified with the drag block configurations 112, 114, respectively, formed integrally on the tubing exteriors. The configurations of the two drag block portions 112, 114 of the tubing are substantially identical to the first described embodiments and function in substantially the same manner as the first described embodiments. By providing the drag blocks 112, 114 as integral parts of subtubing and production tubing, the benefit of increasing the fluid resistance of a string of production tubing provided by adding the first described embodiment of the drag block to the exterior of a joint of tubing in the string is provided by merely adding the modified subtubing 116 or production tubing 118 to the string while running the string of tubing into a well.

Figure 18:
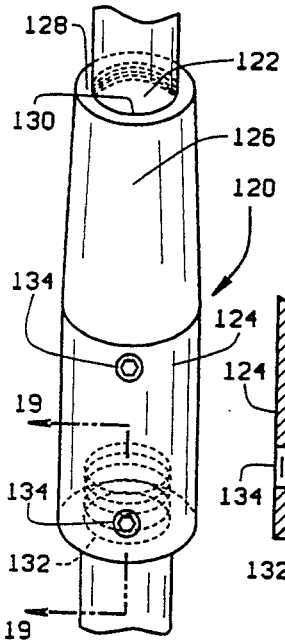
FIG. 18 is a perspective view of a further embodiment of the invention.
Figure 19:
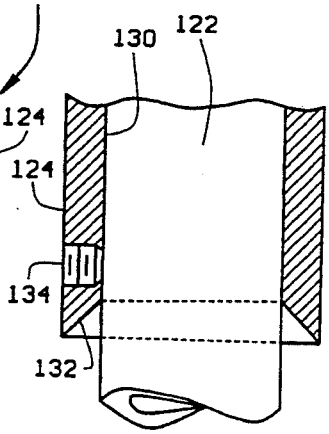
FIG. 19 is a partial elevation view, in section, taken along the line 19—19 of FIG. 18.

FIGS. 18 and 19 show a still further embodiment of the drag block 120 of the invention. The drag block 120 is shown secured on the exterior surface of a joint of production tubing 122. Like the first embodiment, this embodiment of the drag block 120 is constructed of a single piece of material having an exterior surface with a lower section 124 and an upper section 126, the lower and upper sections of this embodiment of the invention being substantially identical to the middle section 26 and top end section 28 of the first embodiment of the invention. As in the first embodiment, the upper section 126 has the exterior configuration of a truncated cone with the upper section tapering from the lower section 124 to the distal top end 128 of the drag block. The lower section 124 of the drag block exterior surface is formed with a cylindrical configuration as was the middle section 26 of the first described embodiment. A center bore 130 extends longitudinally through the interior of the drag block between the opposite top end 128 and bottom end 132 of the block. The center bore 130 has an inside diameter dimensioned slightly larger than the outside diameter of the male end of the production tubing 122 over which the drag block must fit. A pair of threaded holes (not shown) extend from the exterior surface of the block lower section 124 through to the center bore 130 and a set screw 134 is screw threaded into each of the holes.

As best seen in FIG. 19, the bottom end surface 132 of the drag block 120 is tapered upwardly and inwardly as it extends from the peripheral surface of the lower section 124 toward the center bore 130. This forms a cup-shaped cavity in the lower end of this embodiment of the drag block. The cup shape of this cavity enhances the ability of the drag block 120 to resist fluid flow upward over the exterior surface of the tubing 122 and increases the fluid resistance of the tubing exterior surface, so that the fluid resistance in this configuration is the same or greater than the fluid resistance of a drag block with a greater outside diameter but without this enhancement. By providing a greater spacing between the drag block exterior surface and the well casing interior surface and the same fluid resistance as a drag block with a larger outside diameter 26, 54, this embodiment of the drag block may be employed where there is an increased probability of the tubing becoming stuck when pulled out of the hole due to scale such as iron sulfide, corrosion or paraffin building up around the upper end 126 of the drag block, thus wedging it inside the well. Although a one piece slip on configuration is shown in the drawing figures, the embodiment of the drag block shown in FIGS. 18 and 19 may also be constructed in a two-part configuration such as that of the embodiment of the drag block shown in FIGS. 3–13 or in the screw on configuration as shown in FIGS. 14–17.

In variant embodiments of the drag block shown in FIGS. 18 and 19 which are employed on production and in casing pipe having various different dimensions, the dimensions of the drag block will correspondingly change. Moreover, proportionate lengths of the upper and lower sections 126, 124 of the drag block may change.

As in the first embodiment of the drag block, the embodiment shown in FIGS. 18 and 19 is attached over a joint of production tubing 122 that is one in a series of joints of tubing connected end to end and inserted down the inside of a well. The connection of the drag block 126 to the exterior surface of the tubing is done in substantially the same manner as that described above with reference to FIGS. 1 and 2 of the first embodiment, or may be screwed into the production tubing string as described above with reference to FIGS. 14–17.

As a still further variant of the embodiments of the drag block employing either interior or exterior screw threads for attaching the drag block embodiments between adjacent joints of production tubing, the threading of the drag block can be purposely constructed so that it would have a tensile strength of about 5,000 pounds. This modified embodiment of the drag block would be run at the very bottom of a string of production tubing. If the drag block should become stuck in the well it could be pulled loose at its top threads. The stuck drag block could then be pushed downward to the bottom of the well leaving only a minor amount of loose tubing in the well, thereby minimizing losses due to a stuck drag block.

While the present invention has been described by reference to specific embodiments employed in specific operative environments, it should be understood that modifications and variations of the invention may be constructed without departing from the scope of the invention defined in the following claims.

What is claimed is:

1. In a well comprising a casing extending down through the well, the casing having a cylindrical interior surface with an inner diameter, an improvement for avoiding damage to the casing and to production tubing inside the casing due to inadvertently dropping the production tubing down the casing interior, said improvement comprising:

a joint of production tubing having opposite bottom and top ends and a generally cylindrical exterior surface between the bottom and top ends; and at least one drag block secured to the tubing, the drag block having an exterior surface with at least a portion of the exterior surface having a circular cross section with an outer diameter that is the largest outer diameter of the drag block and is dimensioned slightly smaller than the inner diameter of the casing, producing a restriction to fluid flow between the drag block exterior surface and the casing interior surface and increasing the fluid drag of the joint of production tubing whereby the drag block inhibits and slows a rate of descent of the production tubing when inadvertently dropped through the interior of the casing.

2. The improvement of claim 1, wherein:

the drag block has a center bore and is attached over the exterior surface of the production tubing by passing the center bore over one of the bottom and top ends of the tubing.

3. The improvement of claim 1, wherein:

the drag block has a center bore with an inner diameter dimensioned slightly larger than an outer diameter of the production tubing exterior surface enabling the center bore to slide over the tubing exterior surface and means for securing the drag block to the tubing exterior surface are provided on the drag block.

4. The improvement of claim 3, wherein:

the improvement for securing the drag block to the exterior surface of the production tubing includes at least one set screw mounted on the drag block for adjustment of the set screw into the drag block center bore and into engagement with the production tubing exterior surface to thereby secure the drag block on the production tubing.

5. The improvement of claim 1, wherein:

the drag block is comprised of a plurality of separate parts that are assembled to each other around the exterior surface of the production tubing to secure the drag block to the production tubing.

6. The improvement of claim 5, wherein:

the drag block is comprised of a pair of separate parts with each part having means for assembling the parts to each other around the exterior surface of the production tubing to thereby secure the drag block to the production tubing.

7. The improvement of claim 6, wherein:

the pair of separate parts are substantially identical to each other.

8. The improvement of claim 1, wherein:

a plurality of like drag blocks are secured to the production tubing with each of the drag blocks of the plurality being spatially arranged between a plurality of joints of tubing.

9. The improvement of claim 8, wherein:

each drag block of the plurality of drag blocks secured to the production tubing has a circular cross section with an outer diameter of each drag block of the plurality of drag blocks arranged between the joints of production tubing being different diameters.

10. The improvement of claim 1, wherein:

the exterior surface of the drag block is configured to produce a restriction to a flow of fluid contained inside the casing between the drag block exterior surface and the casing interior surface.

11. The improvement of claim 1, wherein:

the exterior surface of the drag block is configured with a cylindrical middle surface having an outer diameter slightly smaller than the casing interior diameter, and with end surfaces at opposite sides of the middle surface, the end surfaces both having a truncated cone configuration that tapers from the middle surface to opposite ends of the drag block adjacent the production tubing exterior surface.

12. The improvement of claim 1, wherein:

the exterior surface of the drag block is configured with a cylindrical peripheral surface having an outer diameter smaller than the casing interior diameter, and with a bottom end surface that tapers upwardly and inwardly as it extends from the cylindrical peripheral surface toward a center axis of the drag block.

13. In a well having a cylindrical interior surface with an inner diameter, and fitted with a length of production tubing extending down through the well, the production tubing having opposite top and bottom ends and a generally cylindrical exterior surface between the top and bottom ends, an improvement for avoiding damage to the well and to the length of production tubing due to the production tubing being inadvertently dropped down through the well, the improvement comprising:

at least one drag block adapted to be attached to at least one length of production tubing thereby increasing fluid drag of the tubing, the drag block having an exterior surface width at least a portion of the drag block exterior surface having a circular cross section with an outer diameter dimension larger than an exterior diameter of the production tubing and smaller than the well interior diameter producing a restriction to a flow of fluid between the well interior surface and the drag block exterior surface whereby the drag block attached to the length of production tubing inhibits descent of the tubing through fluid contained in the well interior when the tubing is inadvertently dropped through the well.

14. The improvement of claim 13, wherein:

a plurality of like drag blocks are attached to the production tubing spatially arranged along its length.

15. The improvement of claim 14, wherein:

the outer diameter of each of the drag blocks of the plurality of drag blocks is different.

16. The improvement of claim 13, wherein:

the exterior surface of the drag block is configured with a cylindrical middle surface having an exterior diameter slightly smaller than the interior diameter of the well, and with at least one end surface adjacent the middle surface, the end surface having a configuration of a truncated cone that tapers from the middle surface to an end of the drag block.

17. The improvement of claim 13, wherein:

the drag block has a center bore and is attached over an exterior surface of the length of production tubing by passing the center bore over one of the top and bottom ends of the tubing, and means are provided on the drag block for securing the drag block to the production tubing exterior surface.

18. The improvement of claim 13, wherein:

the drag block is comprised of a plurality of separate parts with each part attached to each other around the production tubing to thereby attach the drag block to the production tubing.

19. The improvement of claim 18, wherein:

each part of the plurality of separate parts is substantially identical to each other.

20. The improvement of claim 14, wherein:

the plurality of drag blocks attached to the length of production tubing each have an exterior surface configured to prevent the tubing from contacting the well interior surface and prevent bending of tubing inadvertently dropped down the well.

21. The improvement of claim 13, wherein:

the exterior surface of the drag block is configured with a cylindrical peripheral surface having an exterior diameter smaller than the interior diameter of the well, and with a bottom end surface having a configuration that extends upwardly and inwardly from the peripheral surface toward a center axis of the drag block.

22. The improvement of claim 13, wherein:

the drag block has screw threads provided at opposite ends of the drag block and the screw threads are dimensioned complementary to screw threads provided at ends of adjacent joints of production tubing in the length of production tubing and enable the drag blocks to be attached to the length of production tubing by the screw threads at the opposite ends of the drag block being connected with the screw threads at the ends of the adjacent joints of production tubing.

23. The improvement of claim 22, wherein:

the drag block screw threads are external screw threads.

24. The improvement of claim 22, wherein:

the drag block screw threads are internal screw threads.

25. The improvement of claim 22, wherein:

the length of production tubing is comprised of a plurality of connected joints of production tubing and, the drag block has a length substantially equal to a length of a joint of production tubing.

* * * * *